US008820012B2

(12) United States Patent
Hsieh

(10) Patent No.: US 8,820,012 B2
(45) Date of Patent: Sep. 2, 2014

(54) INTEGRATED LOCALIZATION STEEL FRAME USED IN LIGHTWEIGHT STEEL BUILDING

(76) Inventor: Ying Chun Hsieh, Fengyuan (TW)

( * ) Notice: Subject to any disclaimer, the term of this patent is extended or adjusted under 35 U.S.C. 154(b) by 0 days.

(21) Appl. No.: 13/381,599

(22) PCT Filed: Jun. 1, 2010

(86) PCT No.: PCT/CN2010/000773

§ 371 (c)(1),
(2), (4) Date: Dec. 29, 2011

(87) PCT Pub. No.: WO2011/000206

PCT Pub. Date: Jan. 6, 2011

(65) Prior Publication Data

US 2012/0096789 A1 Apr. 26, 2012

(30) Foreign Application Priority Data

Jun. 30, 2009 (CN) ..... 2009 2 0158989 U

(51) Int. Cl.

| | |
|---|---|
| ***E02D 27/32*** | (2006.01) |
| ***E04H 12/00*** | (2006.01) |
| ***E04C 3/40*** | (2006.01) |
| *E04B 7/02* | (2006.01) |
| *E04B 1/24* | (2006.01) |

(52) U.S. Cl.

CPC . *E04B 1/24* (2013.01); *E04B 7/022* (2013.01); *E04B 2001/2463* (2013.01); *E04B 2001/2496* (2013.01); *E04C 3/40* (2013.01)

USPC ..... 52/294; 52/655.1; 52/653.1

(58) Field of Classification Search

CPC ..... E04B 2001/2415; E04B 2001/2403; E04B 2001/2448; E04B 1/18; E04B 1/24; E04B 2/767

USPC ..... 52/294, 655.1, 653.1

See application file for complete search history.

(56) References Cited

U.S. PATENT DOCUMENTS

| | | | | |
|---|---|---|---|---|
| 4,107,899 | A * | 8/1978 | Crooks | 52/745.13 |
| 4,688,358 | A * | 8/1987 | Madray | 52/93.2 |
| 5,638,917 | A * | 6/1997 | Vennen | 182/150 |

(Continued)

FOREIGN PATENT DOCUMENTS

| | | | |
|---|---|---|---|
| CN | 1090360 | A | 8/1994 |
| CN | 101440635 | A | 5/2009 |
| JP | 10-266341 | A | 10/1998 |
| WO | WO-94/15041 | A1 | 7/1994 |

OTHER PUBLICATIONS

Search Report for International Application PCT/CN2010/000773 dated mailed Sep. 9, 2010.

*Primary Examiner* — Mark Wendell
(74) *Attorney, Agent, or Firm* — Pearne & Gordon LLP

(57) ABSTRACT

The present invention relates to an integrated localization steel frame used in lightweight steel building. The localization steel frame comprises steel columns (2), bracing members (1), and localization members (3) connecting the steel columns (2) and bracing members (1) through fixing connectors (7). The localization members (3) are casted in concrete ring beams (4). The steel columns (2), bracing members (1) and the fixing connectors (7) are connected together in predetermined positions. The localization steel frame has proper structure, and is stressed uniformly and cost effective in construction. It can be assembled simply on site and can improve the construction efficiency. Hence it is more suitable for practical application.

13 Claims, 6 Drawing Sheets

(56) References Cited

U.S. PATENT DOCUMENTS

| | | | | |
|---|---|---|---|---|
| 5,660,005 | A | 8/1997 | Tacoma | |
| 6,523,322 | B1 * | 2/2003 | Michalski et al. | 52/745.05 |
| 7,788,878 | B1 * | 9/2010 | diGirolamo et al. | 52/745.19 |
| 8,091,316 | B2 | 1/2012 | Beck et al. | |
| 2005/0252149 | A1 | 11/2005 | Ritchey et al. | |
| 2008/0159807 | A1 * | 7/2008 | Andrews | 403/363 |
| 2009/0249741 | A1 * | 10/2009 | Cancian | 52/781.3 |
| 2010/0218451 | A1 * | 9/2010 | Andrews | 52/653.1 |

* cited by examiner

INTEGRATED LOCALIZATION STEEL FRAME USED IN LIGHTWEIGHT STEEL BUILDING

TECHNICAL FIELD

The present invention relates to a localization steel frame used in building construction, and in particular to an integrated localization steel frame used in lightweight steel building.

BACKGROUND ART

In the prior art, on site assembled lightweight steel (for example, cold formed thin wall steel structure) buildings using individual members are constructed by pre-fixing the fixing connectors of steel columns and bracing members into a rebar cage of the reinforced concrete ring beams. After concrete is grouted then fixing the steel columns and bracing members to the fixing connectors. The above design has the following problems.

(1) The work procedures of the concrete foundation ring beam are complicated, greatly increase the construction cost of the lightweight steel building.

(2) The steel frame structure requires huge amount of steel columns and bracing members to be fixed and mounted. Fixing members such as anchor bolts have to be embedded into the ring beams in order to join the steel columns bracing members with the ring beams. The embedding procedure is complicated because the positions of each steel frame column and steel strut has to be surveyed and positioned on site. The accuracy of the positions of the embedded anchor bolts as fixing connectors is difficult to control. In practice, the localization of the fixing connectors is a time consuming and strenuous during construction work.

In view of the above defects existing in embedding anchor bolts for individual steel column and bracing member, the present inventor creates a novel integrated localization steel frame used in lightweight steel building based from his rich practice experiences and professional knowledge, combining the application of theory and actively performing the research and innovation, thereby bringing more practicality. After iterations of research, experimentation and improvement, the present invention of great practical value is finally created.

SUMMARY OF THE INVENTION

The main objective of the present invention is to overcome the defects in localization steel columns and bracing members of lightweight steel building by providing a novel integrated localization steel frames used in lightweight steel building. The technical problem to be solved is to have the steel frames better positioned with more evenly distributed load so as to make it more practicable and with the industrial utilization value.

Another objective of the present invention is to provide an integrated localization steel frame used in lightweight steel building which is easy to assemble so as to save construction cost and promote work efficiency, making it more practicable.

Another objective of the present invention is to provide an integrated localization steel frame used in lightweight steel building for solving the technical problem by using localization members, namely cold formed thin-walled profile steels, steel angles or steel channels, having the advantages of high accuracy in linear localization, easy to punch holes, and easy to adjust in three dimensions after being connected, to promote localization accuracy and work efficiency.

Another objective of the present invention is to provide an integrated localization steel frame used in lightweight steel building for solving the technical problem that when the building load is relatively small, the integrated localization steel frame can be used in place of the rebar cage of the reinforced concrete ring beams to save construction cost and promote work efficiency.

The above objectives of the present invention and the technical problems are achieved and solved by the following technical solutions. An integrated localization steel frame used in lightweight steel building according to the present invention comprising steel columns and bracing members, and further comprising localization frame connecting the steel columns and bracings by connectors.

The above objectives of the present invention and the technical problems are further achieved and solved by the following solutions.

The aforesaid integrated localization steel frame used in lightweight steel building, wherein the localization frames are connected through connecting plates when the localization frames are joined.

The aforesaid integrated localization steel frame used in lightweight steel building, wherein the fixing connectors are anchor bolts.

The aforesaid integrated localization steel frame used in lightweight steel building, wherein the localization frames are cold formed thin-walled section steels, steel angles or steel channels.

The aforesaid integrated localization steel frame used in lightweight steel building, wherein the localization connectors are connected through connecting plates when the poisoning connectors are joined together, and the steel columns and bracing members are fixed to and connected with the fixing connectors in pre-determined positions on the localization frames.

The aforesaid integrated localization steel frame used in lightweight steel building, wherein localization holes of the localization members are provided in the sides or bottom portion of the localization frames.

The aforesaid integrated localization steel frame used in lightweight steel building, wherein the localization steel frame further comprises concrete ring beams in which the localization frames are cast; said concrete ring beams are cast on a leveled foundation.

The aforesaid integrated localization steel frame used in lightweight steel building, wherein the localization frames, the steel frame columns and bracing members are fixed on a leveled foundation after they have been assembled, positioned and corrected; and then the concrete ring beams are cast with concrete.

The aforesaid integrated localization steel frame used in lightweight steel building, wherein the localization frames are connected through connecting plates when connecting and localization the localization frames; the localization frames are cast and fixed with concrete after the fixing connectors of the steel columns and bracing members have been mounted and fixed to the localization frames; and then the steel columns and bracing members are connected and fixed in place.

From the above it can be seen that the present invention relates to an integrated localization steel frame used in lightweight steel building. The localization steel frame comprises steel columns and bracing members, and further includes localization frames for connecting the steel columns and bracing members through fixing connectors. The localization frames are cast in concrete ring beams. The steel columns, bracing members and the fixing connectors are connected in pre-determined positions. The localization steel frame has proper structure, and is stressed uniformly and cost effective in construction. It can be assembled simply on site and can improve the construction efficiency. Hence it is more suitable for practical application.

In virtue of the above technical solutions, the present invention has at least the following advantages:

1. Firstly, the integrated localization steel frame used in lightweight steel building according to the present invention has the following advantages comparing with the existing localization means used in lightweight steel building: (1) introducing the concept of localization frames; (2) pre-determining the positions of the steel columns and bracing members, etc., on the localization frames; and (3) the steel columns and bracing members being integrated into one piece through the localization frames, convenient for transmission of stress.

2. The integrated localization steel frame used in lightweight steel building according to the present invention improves the site installation efficiency by using the localization frames; therefore more suitable for practical use.

3. The integrated localization steel frame used in lightweight steel building according to the present invention uses the localization frames in place of the rebar cage in the reinforced concrete ring beam; therefore saving the construction costs. In certain cases of lightweight steel building with simpler structures, even the leveled foundation or the concrete foundation ring beam can be omitted.

4. The integrated localization steel frame used in lightweight steel building according to the present invention has a simple structure with lower manufacturing cost to satisfy the requirements of cost effectiveness. The present invention is above its price in value in its functions and practicability comparing with existing products.

5. The present invention truly complies with the development of the industry in its practicability and cost-effectiveness. The novel invention disclosed herewith is unprecedented, and has never been disclosed in any publications. No similar structure characteristics have been known or used in public before, and no similar products have been commercially available, that is to say, no similar inventions have been disclosed or used in public domain. Therefore the present invention is truly novel.

6. The structure of the present invention is indeed more advanced than the localization means used in existing lightweight steel building and localization means used in existing lightweight steel building are far from comparison with respect to the unique structural characteristics and functions of the present invention. The present invention has many increased functions relative to the current steel frame localization used in lightweight steel building so as to make it more technically advancements. Therefore, the present invention is indeed inventive.

In conclusion, the claimed integrated localization steel frame used in lightweight steel building of special configuration is more adapted for practicality thanks to its advantages. The same kind of the product does not disclose or use the similar structural design, and thereby the claimed integrated localization steel frame used in lightweight steel building is novel indeed, and makes a great improvement on the structure and function, achieves the great technical advancement and produces the good and practical effects. The integrated localization steel frame used in lightweight steel building has many increased functions relative to the current steel frame localization used in lightweight steel building so as to make it more adapted for the practicality and have the wide commercial utilization value. Therefore, the claimed integrated localization steel frame used in lightweight steel building is a novel, advanced and practical design.

The above description is only a generalization for the technical solutions of the present invention. To understand the technical means more clearly and carry out the invention according to the description, the preferred embodiments of the invention are described hereinafter in conjunction with the drawings.

Here is the specific structure of the invention as described by the embodiments and the drawings.

| | | | |
|---|---|---|---|
| 1: | steel bracing member | 2: | steel column |
| 3: | localization frame | 4: | concrete ring beam |
| 5: | leveled foundation | 6: | localization hole |
| 701: | fixing connector | 801: | connecting plate |
| 702: | connector anchor bolt | | |

BEST MODE OF CARRYING OUT THE INVENTION

In order to further explain the technical means adopted for achieving the objectives of the invention, the mode of carrying out the claimed invention, characteristics and effects are described in detail hereinafter in combination with the drawings and embodiments.

Figure 1:
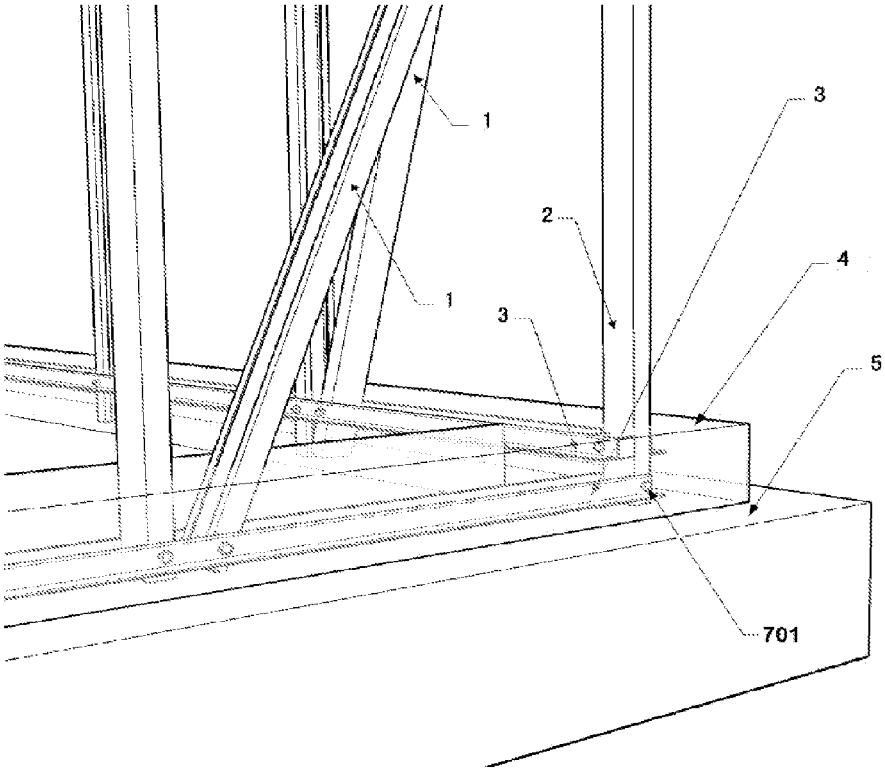
FIG. 1 is an overall schematic view of the integrated localization steel frame used in lightweight steel building according to the present invention; the integrated localization steel frame is formed by one-time on site casting with the steel columns and bracing members.

Referring to FIG. 1, the integrated localization steel frame used in lightweight steel building according to the present invention mainly includes a leveled foundation 5, a concrete ring beam 4, steel columns 2 and steel bracing member 1. The concrete ring beam 4 is cast on the leveled foundation 5. The localization steel frame further includes localization frames 3 cast in the concrete ring beam 4 for connecting the steel columns 2 with the steel bracing members 1. The steel columns 2, the steel bracing members 1 and the localization frames 3 are connected through fixing connectors 701 located in pre-determined positions.

Figure 2:
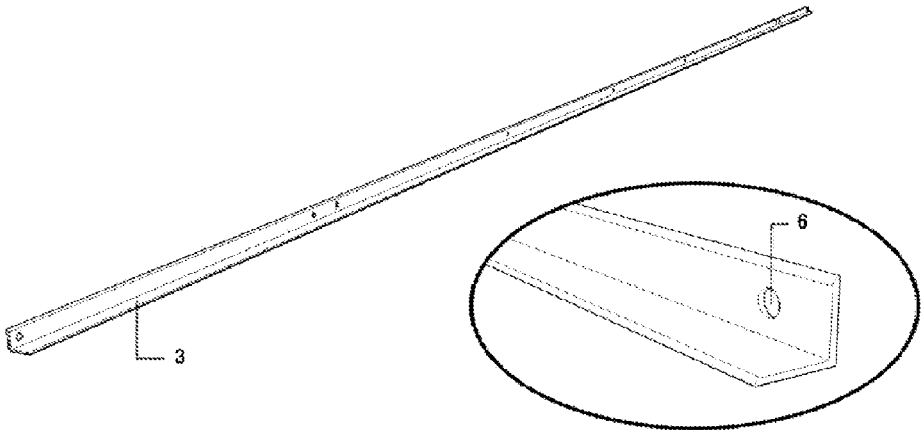
FIG. 2 is a schematic view and a partial enlarged view of the localization frames used in lightweight steel building in FIG. 1.
Figure 3:
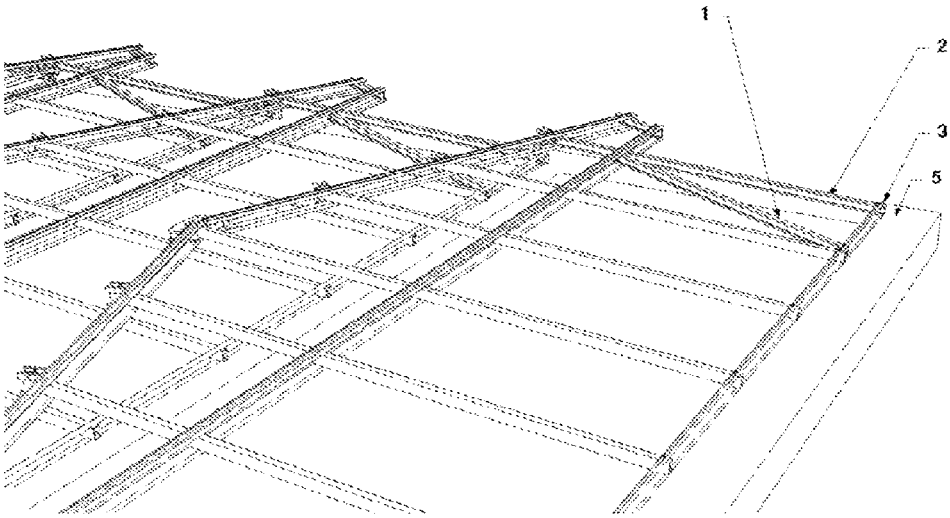
FIG. 3 is a schematic view showing the site operation of the integrated localization steel frame used in lightweight steel building in FIG. 1.
Figure 4:
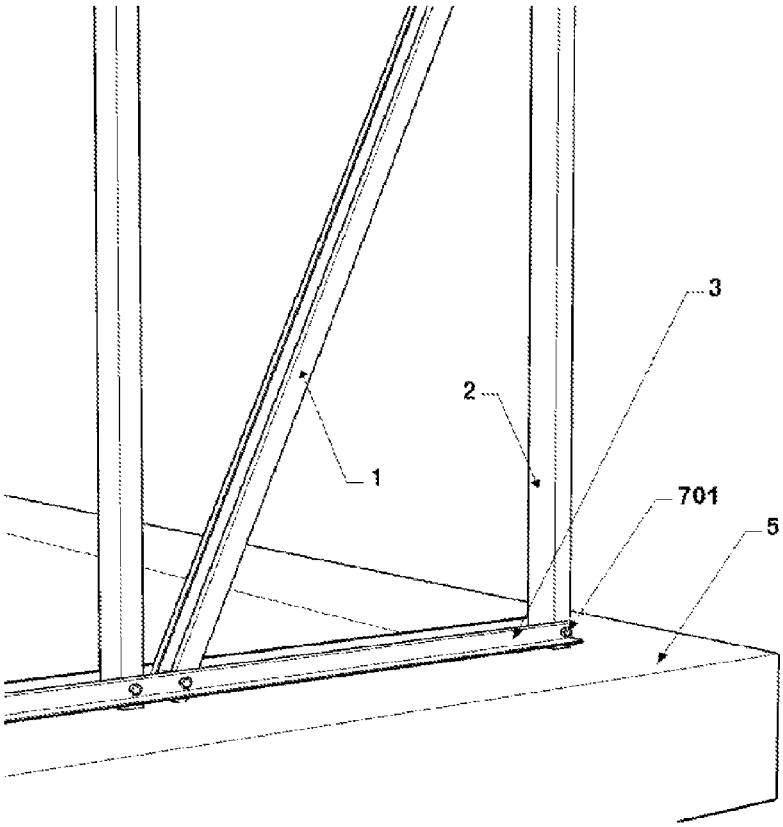
FIG. 4 is a schematic view showing the site operation of the integrated localization steel frame used in lightweight steel building in FIG. 1; with the localization frames on one side having been connected.
Figure 5:
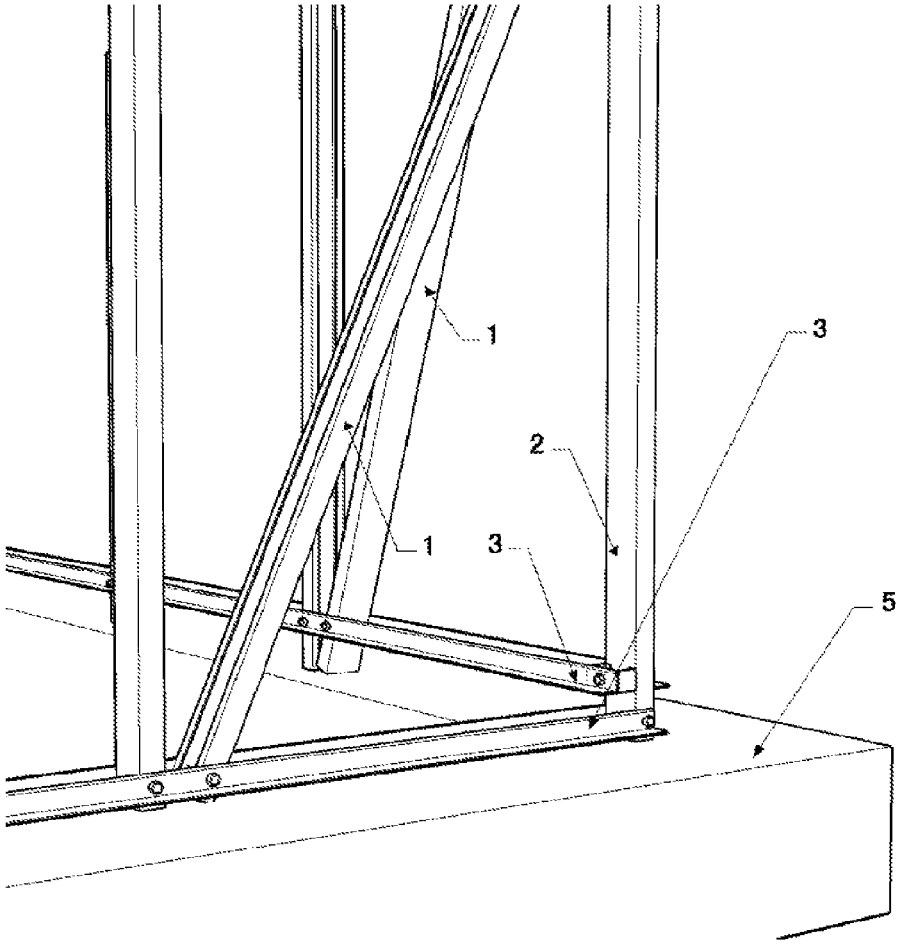
FIG. 5 is a schematic view showing the site operation of the integrated localization steel frame used in lightweight steel building in FIG. 1; with the localization frames on the other side having been connected.
Figure 6:
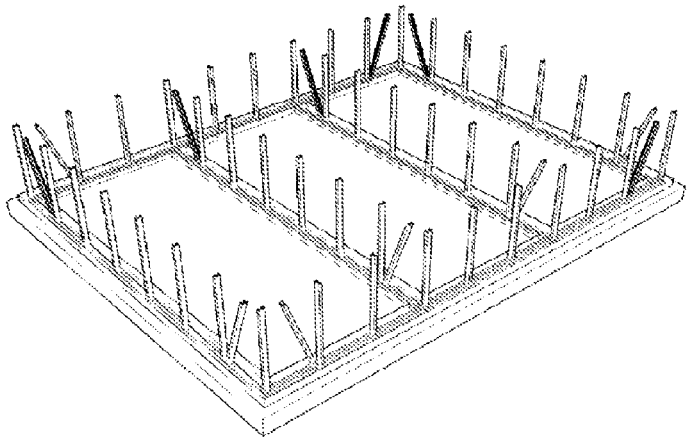
FIG. 6 is an over-all schematic view of the integrated localization steel frame used in lightweight steel building in FIG. 1 with site operation having been completed.
Figure 8:
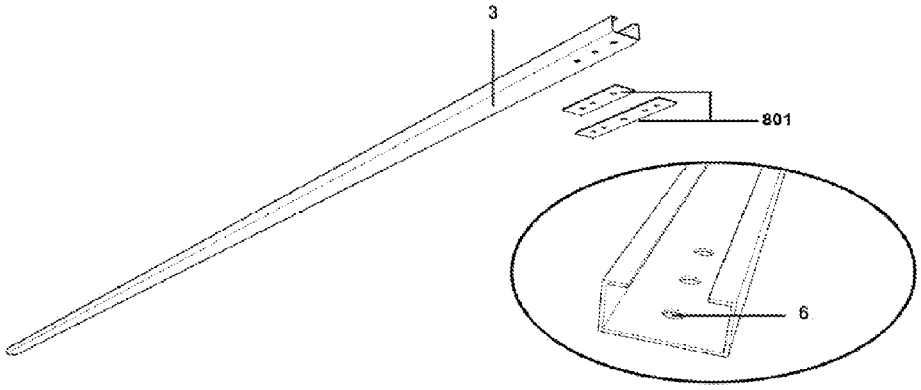
FIG. 8 is a schematic view and a partial enlarged view of the localization frames of the integrated localization steel frame used in lightweight steel building in FIG. 7.

Referring to FIG. 2 illustrating a localization frame 3, in which the enlarged view shows a localization hole 6 located in the side portion of the localization frame 3, while the localization holes 6 in FIG. 8 are located in the bottom portion of the localization frames 3.

FIG. 3 to FIG. 6 show how the localization steel frame is cast on site. From FIG. 4 it can be seen that the localization frames 3 are connected to the steel columns 2 through fixing connectors 701.

Figure 7:
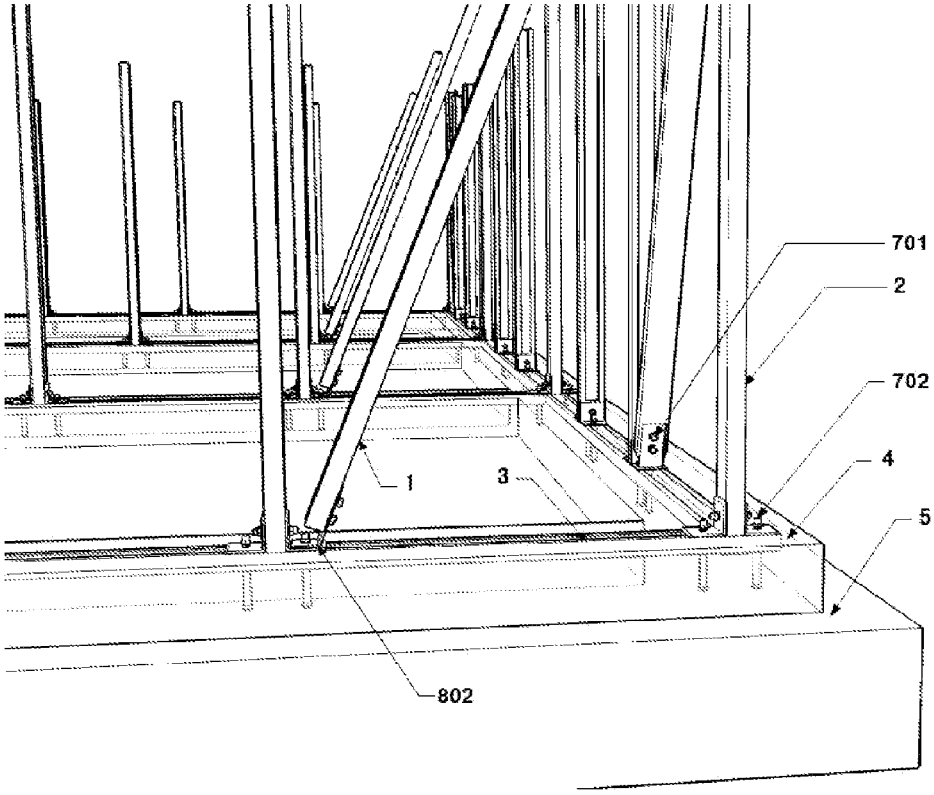
FIG. 7 is an over-all schematic view of the integrated localization steel frame used in lightweight steel building according to the present invention; the integrated localization steel frame is constructed with embedded localization frames and anchor bolt-type connectors.
Figure 10:
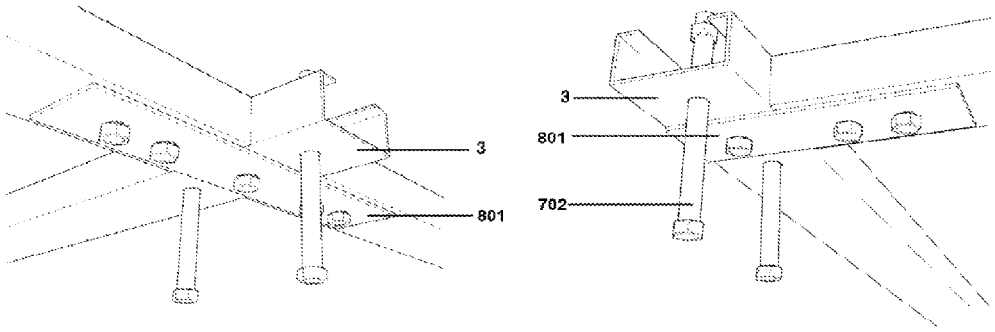
FIG. 10 is a schematic view showing how the localization frames, the anchor bolts and the connecting plates of the integrated localization steel frame used in lightweight steel building in FIG. 7 are connected.
Figure 11:
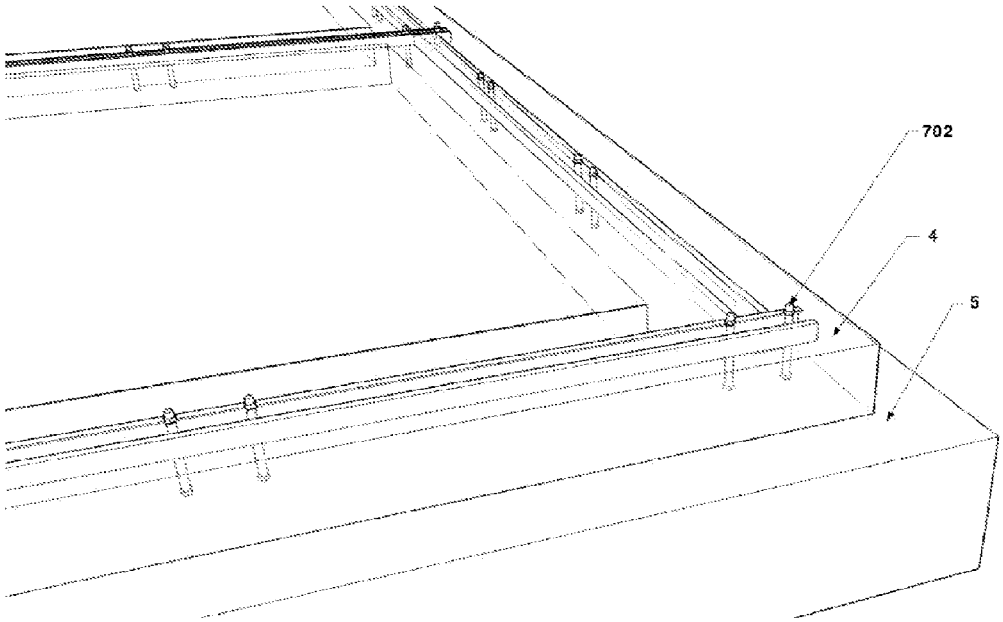
FIG. 11 is a schematic view showing the localization frames and the anchor bolt-type connectors and the concrete ring beam is cast on site and fixed on the leveled foundation in the integrated localization steel frame used in lightweight steel frame building in FIG. 7 are connected.
Figure 12:
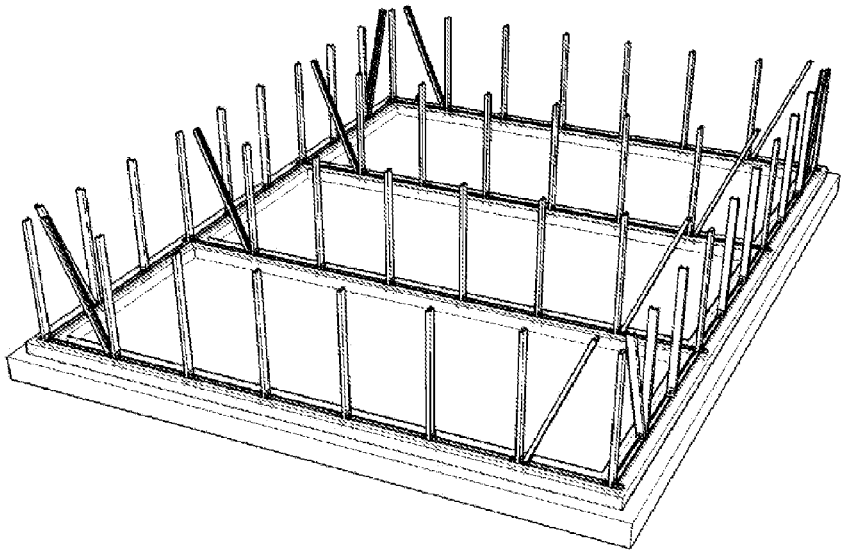
FIG. 12 is an over-all schematic view of the integrated localization steel frame used in lightweight steel frame building in FIG. 7 with site operation having been completed.

Referring to FIGS. 7, 8 and 10, the localization frames 3 are joined by connecting plate 801. The pre-determined positions for fixing and connecting the steel columns, and bracing members and the localization frames 3 are located in the joints between two localization frames 3.

Figure 9:
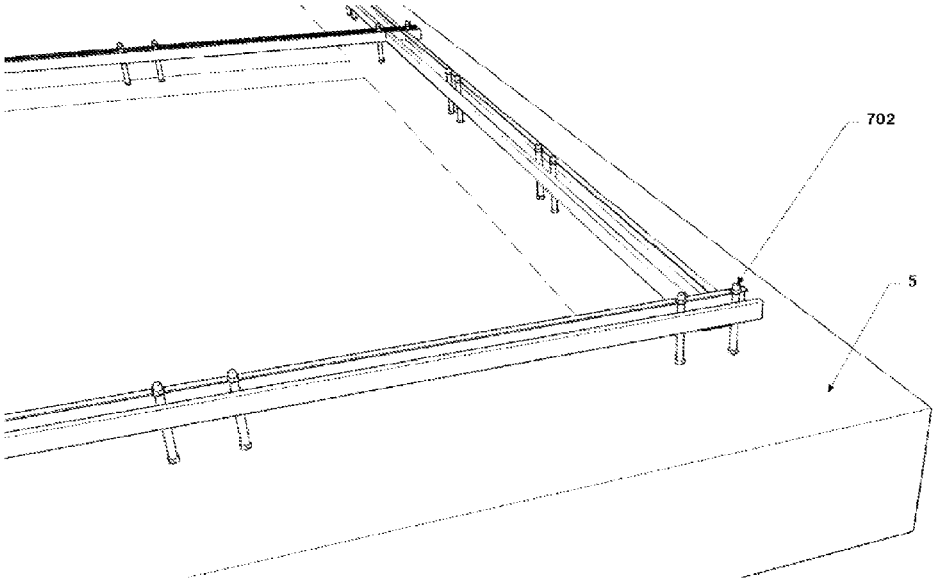
FIG. 9 is a schematic view showing the connection of the localization frames and the anchor bolt of the integrated localization steel frame used in lightweight steel building in FIG. 7.

Referring to FIG. 9, the localization frames 3 and the leveled foundation 5 are connected by connector anchor bolts 702.

Referring to FIGS. 9 to 12, the integrated localization steel frame used in lightweight steel building is constructed by the method of embedding. FIG. 9 shows how the localization frames 3 are connected through localization hole 6 and connector anchor bolts 702.

Generally speaking, the integrated localization steel frame used in lightweight steel frame building can be constructed using at least two methods, for example, cast on site method (referring to FIG. 1-6) and embedding method (referring to FIG. 7-12). In the case of cast on site method, the localization method is such that the over-all localization and adjusting are performed after the over-all connecting of the localization steel frame is completed. Then the steel frame is "falsely" fixed to ensure the vertical angulation of the steel frame in two directions. Then the steel frame is fixed to the leveled foundation 5 through steel columns 2. Finally the concrete ring beam 4 is cast on site. In the case of embedding method, the localization method is such that the localization steel frame is embedded and then the steel frame is connected to the embedded connector anchor bolts 702. In general, in the cast on site method, the steel frame is connected to one pieced, positioned and fixed to place before the concrete ring beam is cast; while in the embedding method, the steel frame is connected to one piece after the members of the steel frame are positioned and fixed to place and the concrete ring beam is cast.

The above description is only a preferred embodiment of the invention, not any type of limitation to the invention. Although the particular embodiment of the present invention has been described above, it will be apparent to those skilled in the art that various changes and modifications can be made without departing from the spirit of the present invention. Any changes and modifications to the above embodiment according to the technical essence of the present invention and without departing from the spirit of the present invention shall be embraced within the technical solution of the present invention.

The invention claimed is:

1. An integrated localization steel frame used in lightweight steel building comprising steel columns and bracing members, wherein the localization steel frame further comprises localization frames connected to respective lower ends of pluralities of said steel columns and of said bracing members via fixing connectors disposed at predetermined positions in said localization frames, wherein said respective lower ends of pluralities of steel columns and bracing members are (i) directly connected to and located between said localization frames, wherein said localization frames comprise parallel steel angles or (ii) indirectly connected to and located on top of said localization frames set in concrete by fixing connectors, wherein said localization frames comprise steel channels with inwardly-directed horizontal flanges, and wherein said fixing connectors are located on said horizontal flanges.

2. The integrated localization steel frame used in lightweight steel building according to claim 1, wherein the localization frames are connected through connecting plates when said respective lower ends of pluralities of steel columns and bracing members are indirectly connected to and located on top of said localization frames.

3. The integrated positioning steel frame used in lightweight steel building according to claim 2, the localization frames are casted and fixed with concrete after the fixing connectors have been mounted and fixed to the localization frames;

and then the steel columns and bracing members are connected and fixed in place.

4. The integrated localization steel frame used in lightweight steel building according to claim 1, wherein the fixing connectors are screw bolts when said respective lower ends of pluralities of steel columns and bracing members are directly connected to and located between said localization frames.

5. The integrated localization steel frame used in lightweight steel building according to claim 1, wherein localization holes of the localization frames are provided in the sides or bottom portion of the localization frames at said predetermined positions.

6. The integrated localization steel frame used in lightweight steel building according to claim 1, wherein the localization steel frame further comprises concrete ring beams in which the localization frames are cast; said concrete ring beams are cast on a leveled foundation.

7. The integrated localization steel frame used in lightweight steel building according to claim 6, wherein the localization frames, the steel columns and bracing members are fixed on the leveled foundation after they have been assembled, positioned and corrected; and then the concrete ring beams are casted.

8. The integrated localization steel frame used in lightweight steel building according to claim 1, said localization frames being positioned along a foundation for said steel building in order to locate the lower ends of said columns and bracing members at locations along said foundation corresponding to said predetermined positions.

9. The integrated localization steel frame used in lightweight steel building according to claim 1, said predetermined positions corresponding to final fixed locations of said lower ends of said columns and bracing members in said steel building when completed.

10. The integrated localization steel frame used in light-weight steel building according to claim 1, said localization frames being embedded in concrete ring beams that are cast on a foundation.

11. The integrated localization steel frame used in light-weight steel building according to claim 1, wherein said respective lower ends of pluralities of said steel columns and of said bracing members are directly connected to and located between localization frames, wherein said localization frames comprise parallel steel angles.

12. The integrated localization steel frame used in light-weight steel building according to claim 1, wherein a top surface of the concrete is substantially parallel to said horizontal flanges.

13. The integrated localization steel frame used in light-weight steel building according to claim 12, the top surface of the concrete being substantially co-planar with said horizontal flanges.

* * * * *